United States Patent [19]

Tirinen

[11] Patent Number: 4,484,359

[45] Date of Patent: Nov. 27, 1984

[54] PADDED GLOVE

[75] Inventor: Juha Tirinen, Helsinki, Finland

[73] Assignee: Yoko-team Oy, Forssa, Finland

[21] Appl. No.: 499,323

[22] Filed: May 31, 1983

[30] Foreign Application Priority Data

Jan. 28, 1983 [FI] Finland ..... 830301

[51] Int. Cl.[3] ..... A41D 13/08

[52] U.S. Cl. ..... 2/20; 2/161 A; 2/161 R; 2/169

[58] Field of Search ..... 2/16, 20, 161 R, 161 A, 2/18, 19, 169

[56] References Cited

U.S. PATENT DOCUMENTS

| | | | |
|---|---|---|---|
| 1,841,193 | 1/1932 | Lidston | 2/16 |
| 3,290,695 | 12/1966 | Burtoff | 2/161 R |
| 3,605,117 | 9/1971 | Latina | 2/16 |
| 3,626,515 | 12/1971 | Murray | 2/161 A |
| 3,945,045 | 5/1976 | Rhee | 2/18 |
| 4,067,063 | 1/1978 | Ettinger | 2/16 X |
| 4,295,229 | 10/1981 | Clark et al. | 2/20 |
| 4,411,024 | 10/1983 | Hayes | 2/20 |

*Primary Examiner*—Werner H. Schroeder
*Assistant Examiner*—Tracy Graveline
*Attorney, Agent, or Firm*—Shenier & O'Connor

[57] ABSTRACT

The invention relates to a padded glove (1) whose back is fitted with at least one padding. The outer portion of the back of a glove consists of an integral layer (2) which is made of a soft material, preferably cellular plastic and which is designed with at least one protrusion (3–7) jutting out of the level of said layer (2).

12 Claims, 1 Drawing Figure

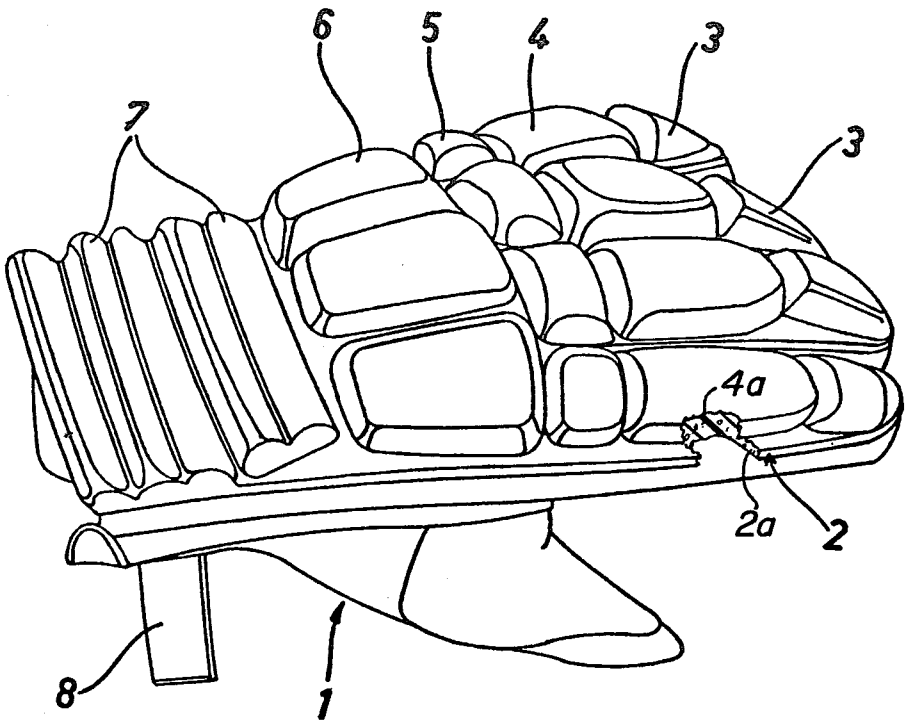
3
3
4
5
6
7
4a
2
2a
1
8

PADDED GLOVE

The present invention relates to a padded glove whose back is fitted with at least one piece of padding.

The gloves having at least the backside thereof padded are used in a variety of applications for protective purposes. Generally, the backside of such a glove is fabricated either of two material layers with pockets designed therein for padding or by fastening individual pieces of padding to the back portion separately. Such fabrication is inconvenient and requires a lot of time.

An object of the invention is to provide a padded glove which provides effective protection and is simple to fabricate.

A glove according to the invention is characterized in that the external back portion of a glove consists of an integral layer of a soft material, preferably cellular plastic, said layer being provided with at least one protrusion jutting out of the level of said layer.

Thus, in a glove of the invention, the back portion thereof as well as the padded protrusion thereon only consists of one single piece. As a result of this, the structure of a glove is simple and its back portion can be fabricated in a single casting step. A back portion produced this way can be readily fastened to the conventional other components of a glove. Owing to the fact that the external back portion consists of an integral layer of a soft material fabricated in a single casting step, it is homogeneous throughout.

Other features of the invention are set forth in the appended subclaims.

The invention will now be described further with reference made to the accompanying drawing which illustrates one example of a glove according to the invention.

In the drawing, a glove 1 is shown from the back.

The thumb of a glove shown in the drawing as well as the inner sides of fingers and the palm are made of leather. The edges of the palm and finger components are made of a textile fabric which is fastened to the leather portions by sewing.

According to the invention, the back of this glove consists of a layer 2 which, in this example, is made of soft cellular plastic. Layer 2 has been configured along the back of a glove, so that said layer 2 completely covers the backside of a palm and four fingers and at the same time covers the wrist to some extent.

This layer 2 has been fastened to the edge portions of a glove by sewing. An alternative approach is to use an intermediate layer which is sewn on the textile portions and adhered to this intermediate layer is layer 2.

Jutting out of the surface of layer 2 are protrusions 3–7 having a variety of heights and shapes. The fingertip areas are provided with smaller protrusions 3 whose height from the tip rearwards increases to form wedge-shaped projections. The finger portion is further fitted with another array of protrusions 4 which are bigger in size than tip portions 3.

At every knuckle, said layer 2 is fitted with a protrusion 5 which is smaller in size than other protrusions.

The palm area is provided with three larger protrusions 6 and the wrist area is provided with transversely extending elongated protrusions 7 whose width is relatively small for more convenient bending of the wrist.

All the above-described protrusions 3–7 form individual elevations jutting out of layer 2 and having a relatively thin and thus flexible material layer therebetween. Thus, the hand can be readily moved and bent in the glove. However, the thickness of protrusions relative to that of layer 2 is quite considerable to provide sufficient padding and protection for the hand pushed in said glove.

As apparent from the above description, the back portion of this glove consists of one single piece configured according to the shape of such glove and said external layer being designed with sizable protrusions which provide the padding. Layer 2 is fabricated of a suitable material, e.g. cellular plastic or rubber or the like. Thus, when the glove is being fabricated, the external layer is moulded in a single piece and it is immediately ready for use. The pads need not be filled or fastened afterwards but the back layer is fastened as such directly to the glove. Since the external layer 2 is moulded in a single piece from cellular material, it is homogeneous throughout the thinner parts such as that indicated by 2*a* of the broken away region in the drawing and the thicker parts such as 4*a* of the broken away region indicated in the drawing. Thus, the side or edge components of a glove are directly fastened to layer 2, or such layer 2 is fastened, e.g. by means of an adhesive, to a lining piece made up by the back portion of a glove. On the other hand, if layer 2 is directly fastened to other components of a glove, the inner face of layer 2 is made smooth or fitted with inner linings.

The mouth of a glove fitting conventionally around the wrist can be tightened by providing a sticker tape 8 adjacent to the mouth and by adhering it to its counter piece on the opposite side of the mouth. Other fastening means can of course be also used.

The above description deals with a leather glove. Naturally, the invention is not limited to any given material combination. The only essential point is that the covering layer 2 is made of auch a material that the protrusions thereon provide a padding for the back of a glove. Neither is the shape of these protrusions in any way limited. For more comfortable use, however, it is preferable that the protrusions form individual smallish components jutting out of the surface of layer 2 in a manner that the hand can be conveniently moved in said glove while the protrusions still effectively protect the entire back portion of the hand.

I claim:

1. A protective glove back portion having an exposed outer surface and an inner surface adapted to be applied to the outer back surface of an ordinary glove for protecting the back of the wearer's hand including a unitary moulded body of energy-absorbing material comprising a relatively thin flexible base extending over the back of the finger and knuckle and metacarpal and wrist areas of the hand and a plurality of discrete energy-absorbing protrusions integral with said base and projecting outwardly therefrom in said areas, said body being homogeneous throughout said base and said protrusions from said inner surface to said exposed outer surface.

2. A glove back portion as in claim 1 in which said protrusions include two protrusions in each finger area, one protrusion in each knuckle area, a plurality of protrusions in the metacarpal area and at least one protrusion in the wrist area extending transversely of the wrist.

3. A glove back portion as in claim 2 in which said base forms the back of a glove.

4. A glove back portion as in claim 3 in which said base is provided with an inner lining.

5. A glove back portion as in claim 3 in which the inner surface of said base is subjected to surface treatment.

6. A glove back portion as in claim 2 in which the height of the outermost of each of said finger area protrusions decreases toward the tip of the finger.

7. A glove back portion as in claim 6 in which said base forms the back of a glove.

8. A glove back portion as in claim 7 in which said base is provided with an inner lining.

9. A glove back portion as in claim 7 in which the inner surface of said base is subjected to surface treatment.

10. A glove back portion as in claim 1 in which said base forms the back of a glove.

11. A glove back portion as in claim 10 in which said base is provided with an inner lining.

12. A glove back portion as in claim 10 in which the inner surface of said base is subjected to surface treatment.

* * * * *